US011192680B2

(12) United States Patent
Hokanson et al.

(10) Patent No.: US 11,192,680 B2
(45) Date of Patent: Dec. 7, 2021

(54) RECLOSABLE CARTON AND BLANK THEREFOR

(71) Applicant: Kimberly-Clark Worldwide, Inc., Neenah, WI (US)

(72) Inventors: Brandon Mark Hokanson, Sheboygan Falls, WI (US); Sydney Leigh Kallenbach, Loveland, CO (US); Timothy Scott Burnham, Larsen, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

(21) Appl. No.: 17/251,366

(22) PCT Filed: Aug. 30, 2018

(86) PCT No.: PCT/US2018/048699

§ 371 (c)(1),
(2) Date: Dec. 11, 2020

(87) PCT Pub. No.: WO2020/046305

PCT Pub. Date: Mar. 5, 2020

(65) Prior Publication Data

US 2021/0253297 A1 Aug. 19, 2021

(51) Int. Cl.

| | |
|---|---|
| ***B65D 5/54*** | (2006.01) |
| ***B65D 5/02*** | (2006.01) |
| ***B65D 5/72*** | (2006.01) |

(52) U.S. Cl.

CPC ..... *B65D 5/544* (2013.01); *B65D 5/0227* (2013.01); *B65D 5/72* (2013.01); *B65D 2517/0008* (2013.01); *B65D 2517/0031* (2013.01)

(58) Field of Classification Search

CPC ..... B65D 5/544; B65D 5/0227; B65D 5/72; B65D 2571/00277; B65D 2401/10; B65D 2571/00444; B65D 71/20

USPC .... 229/221, 244, 149, 147, 148, 152, 198.2, 229/125.28, 237, 925; 206/139, 140, 206/161; 221/302, 303

See application file for complete search history.

(56) References Cited

U.S. PATENT DOCUMENTS

| | | | | |
|---|---|---|---|---|
| 3,064,877 A | | 11/1962 | Forrer et al. | |
| 4,417,661 A | | 11/1983 | Roccaforte | |
| 4,890,789 A | * | 1/1990 | Lo Duca ..... | B65D 5/10 229/102 |

(Continued)

FOREIGN PATENT DOCUMENTS

| | | | |
|---|---|---|---|
| CN | 204341556 | U | 5/2015 |
| JP | 9193926 | A | 7/1997 |
| JP | 2004018010 | A | 1/2004 |

*Primary Examiner* — Christopher R Demeree

(74) *Attorney, Agent, or Firm* — Kimberly-Clark Worldwide, Inc.

(57) ABSTRACT

The present invention provides an enclosed carton for storing and dispensing a plurality of consumer goods. The carton is reclosable and resealable using an interior tuck tab that is formed from one of the carton panels. The tab has a perimeter defined by a line of weakness for separating the interior tuck tab from the carton panel, a first fold line for hingedly connecting the interior tuck tab to the panel and a second fold line spaced apart from the first fold line; and a pair of notches disposed on the interior tuck tab substantially parallel to the second fold line.

20 Claims, 6 Drawing Sheets

(56) References Cited

U.S. PATENT DOCUMENTS

| | | | | |
|---|---|---|---|---|
| 5,803,345 | A * | 9/1998 | Jones | B65D 5/6608 206/807 |
| 6,715,639 | B2 | 4/2004 | Spivey | |
| 6,997,372 | B2 * | 2/2006 | Gasparowicz | B65D 71/18 206/427 |
| 10,189,625 | B2 * | 1/2019 | Bressan | B65D 79/02 |
| 2004/0089671 | A1 | 5/2004 | Miller | |

* cited by examiner

RECLOSABLE CARTON AND BLANK THEREFOR

BACKGROUND

Fully enclosed cartons capable of storing a variety of consumer goods, such as canned beverages have been used in the past. In certain instances these cartons have been provided with dispenser sections for dispensing the carton contents one at a time. Dispenser sections have been provided at various locations within these cartons depending on the design. For example, the carton of U.S. Pat. No. 6,715,639 provides a dispenser section in the opening end of the carton that remains attached to the carton after opening and forms a basket at the opening end of the carton for preventing the package contents from leaving the vicinity of the carton.

In other instances, such as the carton of U.S. Pat. No. 4,417,661, cartons have been provided with dispensing sections located principally on the front wall of the carton. The contents of the carton are accessed and dispensed by completely severing a perforated line defining the dispensing section and folding the wall portion defining the dispensing section about a fold line.

In still other instances, such as the carton of U.S. Pat. No. 3,265,283, consumer products, such as canned beverages, are stored and dispensed from a fully enclosed carton having a dispensing flap which can be folded down upon opening. To facilitate grasping and removal of the carton contents an aperture extending into the side walls is provided. Once the carton is opened the contents are held in place by an arcuate flap portion extending downwardly in the end wall into the center of the aperture.

Similarly, U.S. Pat. No. 4,364,509 provides a fully enclosed carton with a dispenser in one of the end walls. This dispenser is formed in the end wall by tearing out an end flap and lowering it into proper position. Expansion slits are provided in the side wall for the user's fingers to grasp the carton contents and facilitate removal from the carton. The carton however is not reclosable and does not provide a means for preventing contents from errantly dispensing from the carton once it is opened.

Many of the prior art dispensers suffer from the disadvantage that once open, provide little or no protection for the carton contents and may permit the contents to be dispensed errantly. In addition, it is often not possible to reseal the cartons once opened. In those instances where resealing features are provided they are often unreliable and would not permit the carton to be transported without errantly dispensing its contents. Accordingly, there remains a need in the art for a reclosable carton having a dispensing section that provides adequate access to the carton contents and also provides a means for capturing and retaining the contents.

SUMMARY

The present invention provides an enclosed carton having a novel interior tuck tab, which may function to both provide a carton opening and secure the carton in a closed position when not in use. Generally the novel interior tuck tab is formed entirely within a given panel of the carton and once removed to open the carton can be reinserted into the opening created by its removal to secure the carton without the use of any other packaging materials. In this manner the present invention provides an enclosed carton capable of storing and dispensing consumer goods, having a unique opening and dispensing feature that allows the carton contents to be removed or dispensed without destroying the overall structural integrity of the carton. The dispensing feature may be retained using a unique interior tuck tab to securely close the carton and prevent the contained goods from errantly dispensing.

Accordingly, in one embodiment the present invention provides an enclosed carton having a first panel in folded connection with a second panel, the first panel having an interior tuck tab disposed thereon, the interior tuck tab comprising: a perimeter defined by a line of weakness for separating the interior tuck tab from the first panel; a first fold line for hingedly connecting the interior tuck tab to the top panel and a second fold line spaced apart from the first fold line; and a pair of notches disposed on the interior tuck tab substantially parallel to the second fold line.

In another embodiment the present invention provides an enclosed carton having a first panel in folded connection with a second panel, the first panel having an interior tuck tab disposed thereon, the interior tuck tab comprising a perimeter defined by a line of weakness for separating the interior tuck tab from the first panel; a base portion hingedly connected to the top panel by a first fold line; a tab portion extending continuously from the base portion and having a second fold line separating the tab into first and second portions; and a pair of notches disposed on the tab portion substantially parallel to the second fold line.

In still another embodiment the present invention provides an enclosed carton for storing and dispensing a plurality of consumer goods comprising: a top panel, side panels, a bottom panel, and closed ends; a dispenser hingedly attached to a panel or a closed end, the dispenser moveable through an open and a closed position and creating an opening through which the consumer goods may be removed from the carton; an interior tuck tab formed entirely within a panel or a closed end and hingedly attached thereto by a first fold line, wherein the interior tuck tab comprises a perimeter defined by a line of weakness for separating the interior tuck tab from the first panel or closed end, a base portion, a tab portion having first and second ends, the first end separated from the second end by a second fold line and the first end extending continuously from the base portion; and a pair of notches disposed on the tab portion substantially parallel to the second fold line.

DETAILED DESCRIPTION

Figure 1:
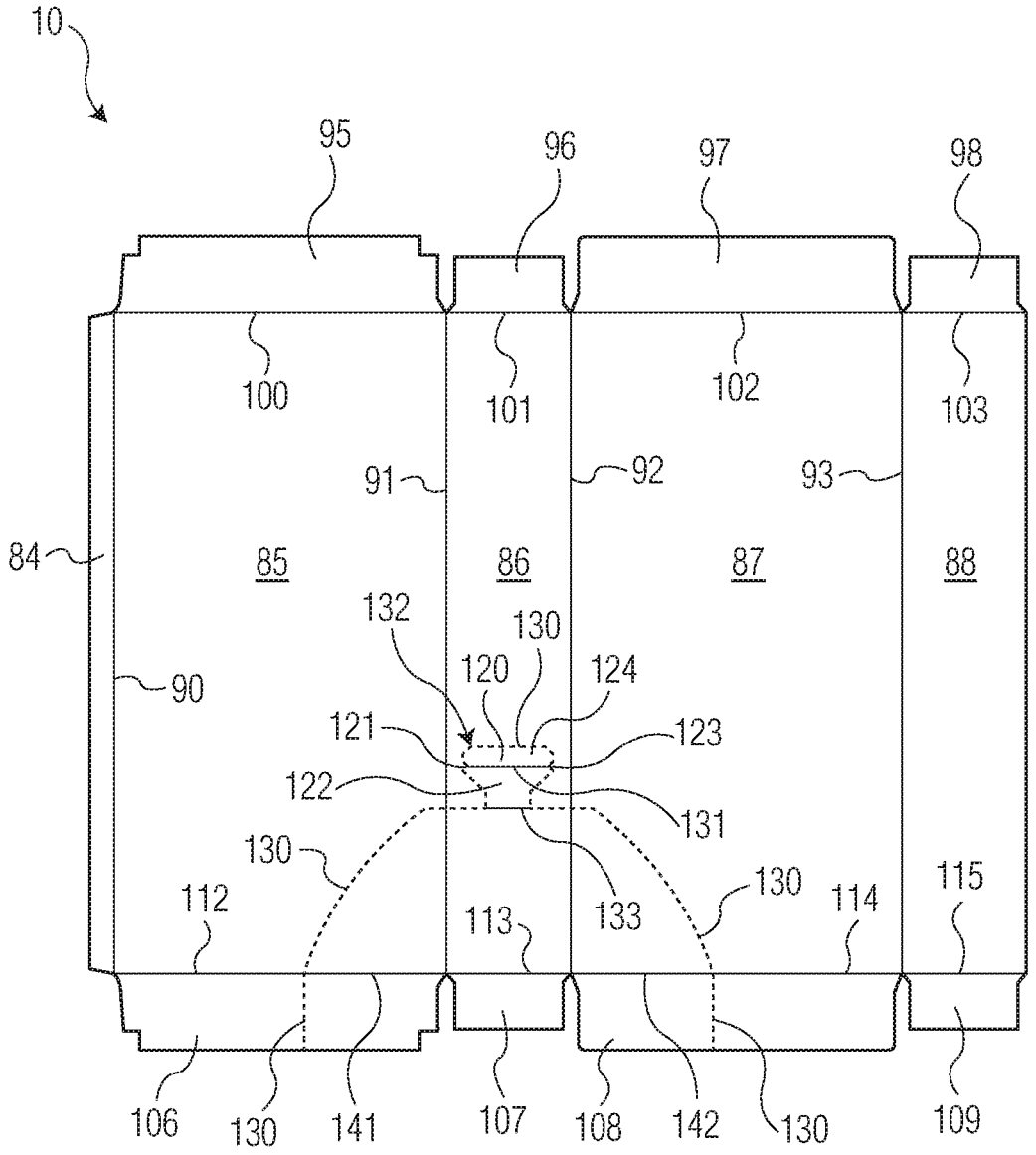
FIG. 1 is a plan view of a blank from which a carton according to this invention is formed.

The present invention provides an enclosed carton for storing and dispensing a plurality of consumer goods, particularly cylindrical consumer goods such as canned goods, canned beverages or foods, as well as rolls of tissue paper, such as rolls of bath tissue. The carton may be formed from a foldable sheet material, such as paperboard, such as the blank illustrated in FIG. 1. The blank 10 has a glue flap 84, a top panel 85, a first side panel 86, a bottom panel 87 and a second side panel 88. These are hingedly coupled together along fold lines 90, 91, 92 and 93. A series of first end closure flaps 95, 96, 97 and 98 are respectively hingedly connected to the tops of the panels along respective fold lines 100, 101, 102 and 103. Similarly, a series of second end closure flaps 106, 107, 108 and 109 hingedly extend from the bottom of these panels respectively along fold lines 112, 113, 114 and 115.

As seen in FIG. 1, the width of the two side panels 85, 87 is substantially equal and somewhat greater than the width of the top and bottom panels 86, 88 so that when folded into a conventional multi-sided carton having a rectangular configuration, the height of the carton is greater than its width. In certain embodiments the top panel may be provided with an opening that may function as a handle, as is known in the art. In other embodiments the top panel may be provided with one or more score lines to assist in dissipating the forces when the carton is lifted by a user, as is known in the art.

Further, as will be appreciated by one of ordinary skill in the art, the blank of FIG. 1 illustrates only one embodiment of a blank useful in forming an enclosed carton having a substantially cubic shape. In other embodiments a carton useful in the invention may be formed from a blank having a first top flap which is connected by a fold line to a first side panel, which in turn is connected by a fold line to a bottom panel. The bottom panel may in-turn be connected by a fold line to a second side panel connected by a fold line to a second top flap. To form the foregoing blank into a carton, the first top flap is secured, such as by gluing or the like, to the second top flap forming a sleeve. The contents to be packaged are loaded into the carton and the carton is closed by folding and securing end flaps extending from the first and second top flaps, side panels, and bottom panels.

Regardless of the exact configuration of the blank, the blank and resulting carton comprise an interior tuck tab that may be separated from the carton when forming the carton opening and then reinserted into a portion of the opening to reseal the carton and facilitate retention of the carton contents. For example, with reference again to FIG. 1 the blank 10 comprises an interior tuck tab 120 disposed on the top panel 86. The interior tuck tab 120 is defined by a line of weakness 130, such as a line of perforations or scoring, disposed about its perimeter. To release the tuck tab 120 from the top panel 86 the line of weakness 130 is broken and the tuck tab 120 is folded along fold line 123, as will be discussed in more detail below. As seen in FIG. 1, the tuck tab 120 has a base portion 120 and a tab portion 124. The illustrated tab portion 124 has curvilinear side edges and a substantially straight first edge 130, while the base portion 122 is generally rectangular. The base portion 122 is hingedly connected to the top panel 86 by a second fold line 133. While the tuck tab 120 of FIG. 1 has a rectangular base portion 122 and a tab portion 124 having linear and curvilinear portions, one skilled in the art will appreciate that the tuck tab, or its constituent parts, may have any desirable shape such as rectangular, square, triangular, oval or tear drop.

As seen in FIG. 1, the interior tuck tab 120 is defined by a line of weakness 130 extending about its perimeter. The first portion of the line of weakness is in the configuration of two spaced, straight parallel portions located entirely within the front panel 86 and spaced from the opposed fold lines 91 and 92, which define the side edges of the bottom panel. The line of weakness 130 continues in a curvilinear fashion along the perimeter of the tuck tab 120 and then in a substantially straight line portion to define a distal edge 132, which may be arranged substantially parallel to fold line 113. In certain embodiments the line of weakness may extend from the distal edge of the tab to define a starter tab, which may also be located in the top panel, to facilitate breaking the line of weakness and separating the tab from the top panel. Alternatively, top panel may be provided with a finger flap at a point adjacent to the perimeter of the interior tuck tab to provide for the easy insertion of the fingers to start the tearing of the line of weakness and separation of the interior tuck tab from the top panel.

With continued reference to FIG. 1, in addition to defining the perimeter of the interior tuck tab 120, the lines of weakness 130 cross fold lines 91, 92 separating the top panel 86 and the two adjacent side panels 85, 87 to define a carton opening. In certain instances the line of weakness 130 may continue to extend across fold lines 141, 142 and across a portion of flaps 106, 108, such as shown in FIG. 1. Just as the shape of the line of weakness defining the perimeter of the tuck tab is non-limiting, the shape of the line of weakness as it is disposed along the first and second side panels and optionally flaps extending therefrom is non-limiting and may take any number of different shapes depending on the desired shape and configuration of the carton opening.

Figure 2:
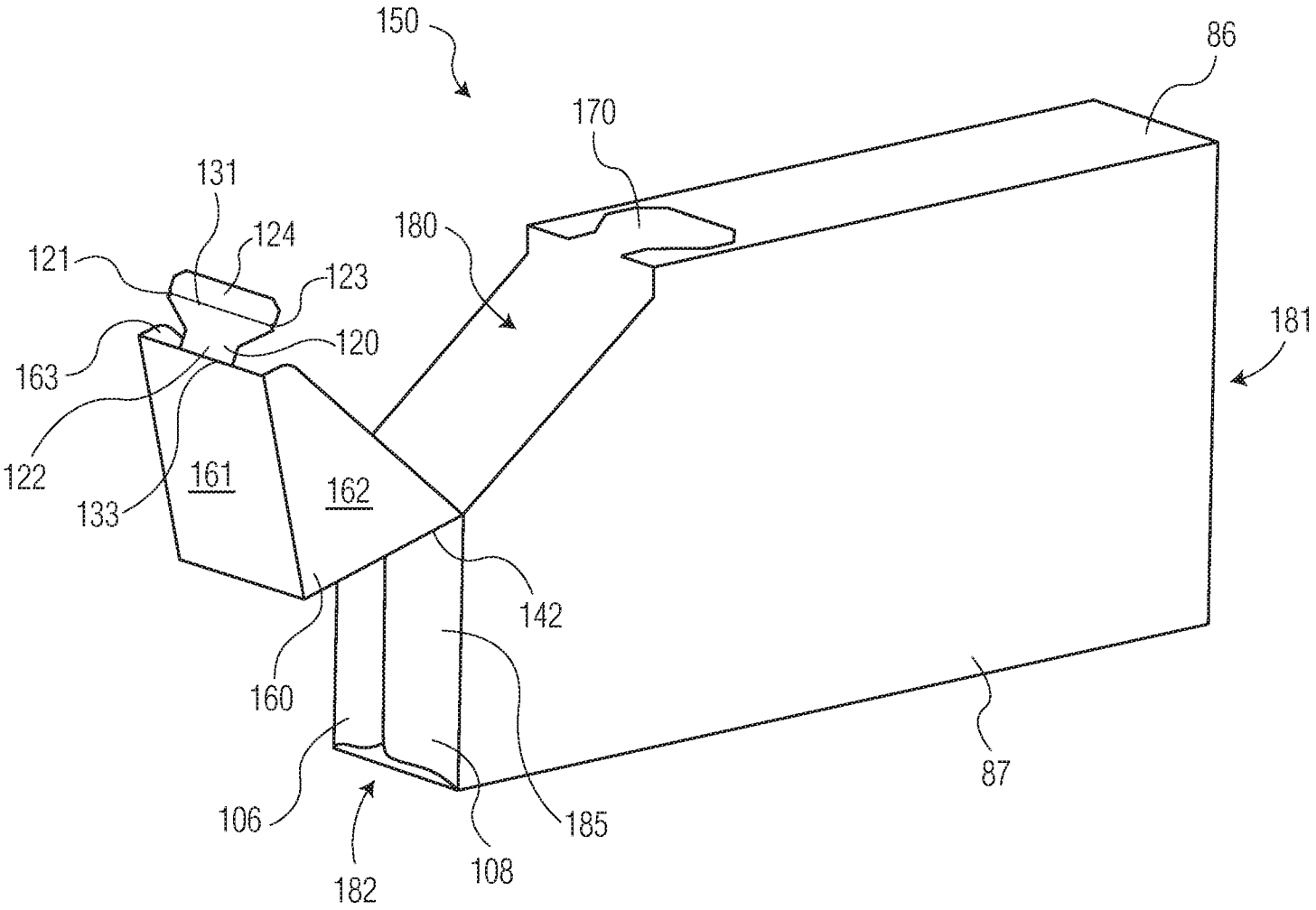
FIG. 2 is a perspective end view of the carton of the present invention showing the carton being in an open configuration.

With reference now to FIG. 2, when the blank of FIG. 1 is folded and glued, the resulting carton 150 has a closed end 181 and an opening end 182. The opening end 182, which forms a portion of the carton opening 180 which is formed by opening the hinged lid 160, also referred to herein as a dispenser. However, in certain embodiments a dispenser can be placed on both ends of the carton. The carton contents are dispensed from the carton 150 through the opening end 182 of the carton and more specifically through the carton opening 180. The hinged lid 160 is formed by tearing along a line of weakness (shown in the blank of FIG. 1) which extends from the top panel 86 through side panels 85, 87 and into side end flaps 106, 108. In the present embodiment the line of weakness extends into side end flaps 106, 108 so as to leave a bottom portion 185 and provide structural integrity to the carton 150.

The carton 150, which is a unitary structure, is opened by breaking a line of weakness and pivoting the lid 160, which is hingedly attached to the pair of end panels 106, 108 by a pair of fold lines (fold line 142 illustrated in FIG. 2). When opening the carton 150 the interior tuck tab 120 is separated from the top panel 86, leaving a void 170. The interior tuck tab 120 remains attached to a portion of the top panel 161 is connected thereto by a second fold line 133.

The carton may be opened by a person depressing the tuck tab with his or her fingers to break the line of weakness and then pulling the tuck tab upwards to continue breaking the line of weakness along the top panel and then along each of the side panels. In certain instances an insertion flap may be provided adjacent to the tuck tab to facilitate the entry of the fingers and opening of the carton. In a particularly preferred embodiment an insertion flap may be positioned such that a user's finger will enter the interior of the carton between adjacent carton contents, such as two adjacent rolls of toilet tissue.

When the carton 150 is opened and the hinged lid 160 is partially separated, the lid 160 has a pair of sidewalls (sidewall 162 visible in FIG. 2) which are formed from a portion of the carton sidewalls (carton sidewall 87 visible in FIG. 2). The pair of lid sidewalls and top wall, which is formed from a portion of the carton top panel, generally form a three sided lid that is hingedly connected to the front panel of the carton. When the hinged lid 160 is pivoted to an open position, such as that illustrated in FIG. 2, the sidewalls may form a basket to catch and carton contents as they are dispensed.

In order to maintain the structural integrity of the carton it may be preferable that the bottom portion of the end flaps 106, 108 be retained when the hinged lid 160 is formed and the carton 150 is opened. In this embodiment the opening end 182 is provided with a bottom portion 185 that remains unopened and lends structural integrity to the carton 150. The height of the bottom portion may be optimized to provide adequate retention of the carton contents while still providing the requisite amount of structural integrity. In certain instances the height of the bottom portion may be greater than the diameter of the carton contents, such as a height greater than the diameter of a roll of toilet tissue.

Figure 3:
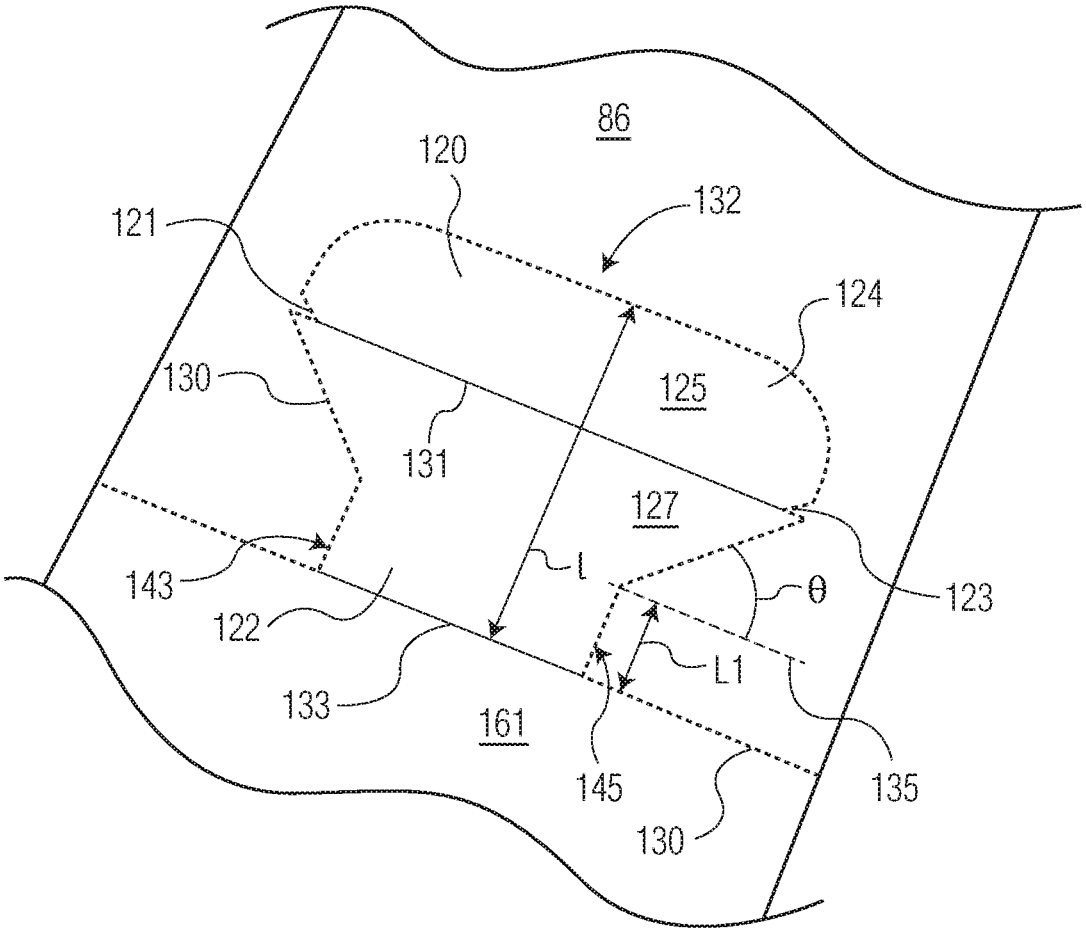
FIG. 3 is a top plan view of a tuck tab disposed on the top panel of a carton according to one embodiment of the present invention.

With reference now to FIG. 3 an interior tuck tab 120, also referred to herein as an angled interior tuck tab or angled tuck tab, is illustrated in greater detail. The interior tuck tab 120, the perimeter of which is generally defined by a line of weakness 130, may be divided into two portions a base portion 122 and a tab portion 124. The tab portion 124 may further be divided into first and second tab portions 125, 127 separated from one another by a first fold line 131. In certain embodiments the first fold line 131 may extend substantially parallel to fold line 113 separating top panel 86 from end flap and may also be arranged substantially parallel to the second fold line 133. In certain instances the first fold line 131 may divide the tab portion 124 into first and second portions 125, 127 of substantially equal lengths, while in other instances the first and second tab portions 125, 127 may have different lengths.

The first tab portion 125 generally terminates at a first distal edge 132, which in the illustrated embodiment forms a substantially straight edge that is arranged parallel to the first fold line 131. While the distal edge is illustrated as being straight the invention is not so limited and the distal edge may take any number of different shapes, such as curvilinear or the like.

The second tab portion 127 generally has a pair of opposed sidewalls that are angled relative to a reference line 135 separating the second tab portion 127 from the base portion 122 and generally parallel to the first fold line 131. In this manner the pair of opposed angled sidewalls provide the tab 124 with an angular portion. The angle of the sidewalls, which is generally designated as 0, may range from about 30 to about 60 degrees, such as from about 40 to about 50 degrees and more preferably from about 42 to about 48 degrees.

The tab portion 124 further comprises a pair of notches 121, 123, which are disposed at either end of the first fold line 131. The notches may be simply slits or cuts, or may be V-shaped notches formed in adjoining sections at opposite ends of the first fold line 131. As will be discussed in more detail below, the notches 121, 123 may be used to lock the interior tuck tab 120 into the receiving portion of the top panel 86 to secure the carton's hinged lid in a closed position.

Continuous with the tab portion 124 and hingedly connected to the top panel 86 by a second fold line 133 is a base portion 122. In the illustrated embodiment, the base portion 122 is generally defined by a pair of spaced apart, parallel edges 143, 145. The edges 143, 145 may be spaced apart from one another so as to provide the base portion 122 with a width from about 40 to about 100 mm, although the width may vary depending on the width of the panel on which the tab is disposed. While the interior tuck tab of FIG. 3 comprises a base portion, the invention is not so limited as will be discussed in more detail below.

The base portion 122 may further be provided with a length (L1), which is generally defined as the length of the pair of spaced apart edges 143, 145. In certain embodiments the length (L1) may range from about 5 to about 50 mm, such as from about 10 to about 25 mm, such as from about 12 to about 20 mm. The length (L1) may be varied to ensure secure engagement of the notches 121, 123 when the tab 120 is secured as described in more detailed below. In other instances the length (L1) may be varied so as to minimize any gap formed when securing the tab and closing the carton after removing a portion of its contents. Accordingly, in certain instances L1 may range from about 5 to about 50 mm, such as from about 10 to about 25 mm, such as from about 12 to about 20 mm.

To improve securing of the tab and closing of the carton after use, it may also be desirable to arrange the first and second fold lines 131, 133 such that they are substantially parallel and spaced apart from one another a certain distance (generally abbreviated herein as l2). For example, the first and second fold lines 131, 133 may be spaced apart from one another a distance (l2) from about 10 to about 80 mm, such as from about 20 to about 60 mm. In other instances the interior tuck tab 120 may have a length (l) and the length (l) may be related to the distance (l2) between the first and second fold lines 131, 133 such that the ratio of the length (l) to the distance between the first and second fold lines (l2) is from about 10:1 to about 2:1.

In still other instances the angle of the second tab portion 127 sidewalls (0) may be varied to minimize any gap formed when securing the tab and closing the carton after removing a portion of its contents. Accordingly, in certain embodiments 0 may range from about 15 to about 75 degrees, such as from about 25 to about 50 degrees and more preferably from about 30 to about 45 degrees. In other embodiments the length of the base portion (L1) may range from about 10 to about 30 mm and θ may range from about 25 to about 50 degrees and more preferably from about 30 to about 45 degrees.

Figure 4A:
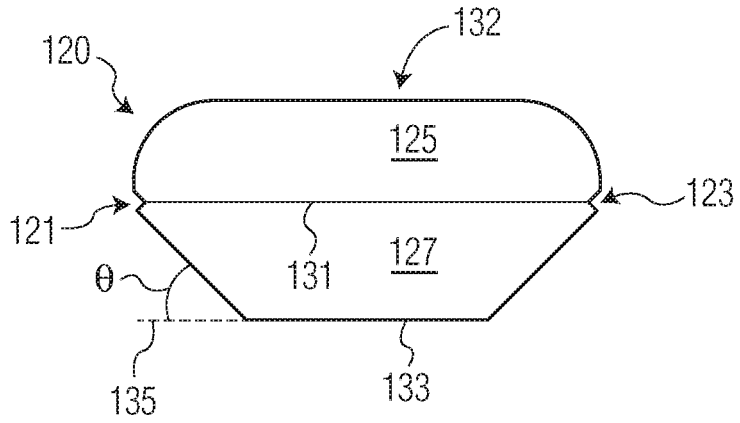
FIG. 4A-4D illustrate various embodiments of angled tuck tabs according to the present invention.

Alternate embodiments of angled interior tuck tabs are illustrated in FIGS. 4A-4D. For example, FIG. 4A illustrates an angled tuck tab 120 having only a tab portion divided into first and second tab portions 125, 127 by a first fold line 131. The angle θ of the second tab portion 127 sidewall, generally defined as the angle between a reference line 135 extending from, and parallel to, the second fold line 133, may range from about 30 to about 60 degrees, such as from about 40 to about 50 degrees and more preferably from about 42 to about 48 degrees.

Figure 4B:
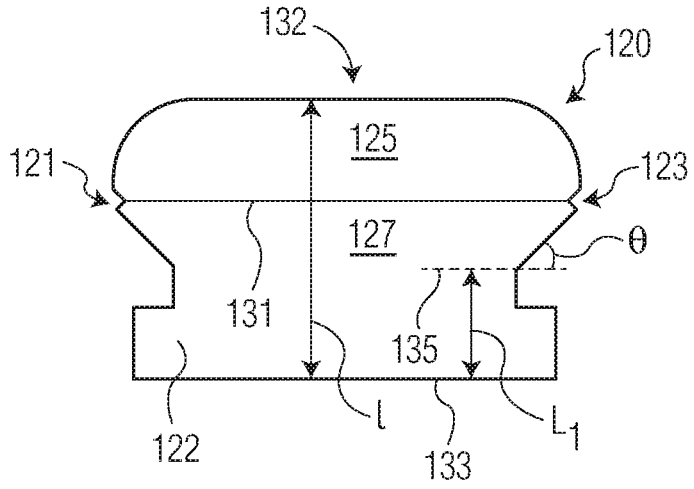

FIG. 4B illustrates another embodiment of an angled tuck tab 120 according to the present invention. The angled tuck tab 120 has a base portion 122, which is not rectangular, hingedly connected to a carton by a second fold line 133, and a tab portion divided into first and second tab portions 125, 127 by a first fold line 131. The second tab portion 127 has angled sidewalls generally arranged at an angle (θ) from about from about 25 to about 50 degrees and more preferably from about 30 to about 45 degrees. The tab 120 has an overall length (l) extending from the distal edge 132 to the second fold line 133 and the base portion 122 has a length (L1) that is less than about 50 percent of (l).

Figure 4C:
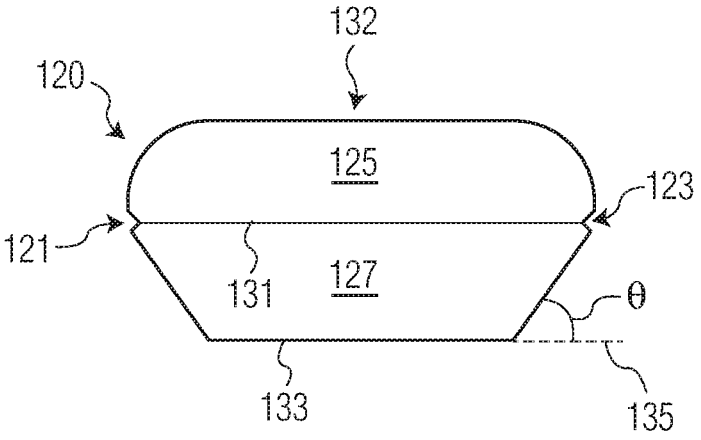

FIG. 4C illustrates yet another angled tuck tab 120 having only a tab portion divided into first and second tab portions 125, 127 by a first fold line 131. The angle θ of the second tab portion 127 sidewall, generally defined as the angle between a reference line 135 extending from, and parallel to, the second fold line 133, may range from about 30 to about 45 degrees.

Figure 4D:
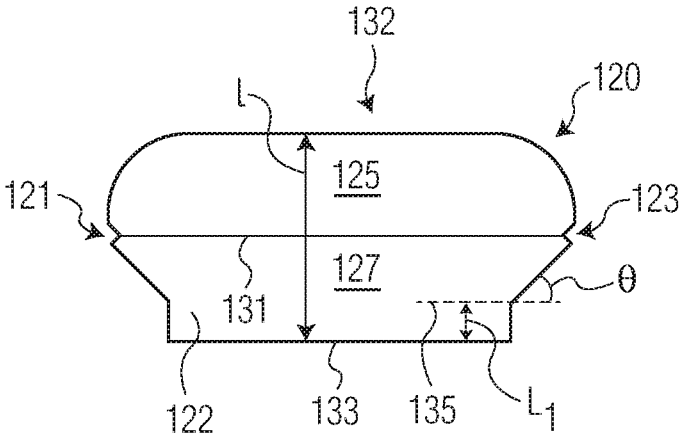

FIG. 4D illustrates still another embodiment of an angled tuck tab 120 according to the present invention. The angled tuck tab 120 has a base portion 122 having a pair of spaced apart and parallel sidewalls that give the base a generally rectangular shape. The base portion 122 is hingedly connected to a carton by a second fold line 133 and continuous with the tab portion, which is divided into first and second tab portions 125, 127 by a first fold line 131. The second tab portion 127 has angled sidewalls generally arranged at an angle θ from about 30 to about 45 degrees. The tab 120 has an overall length (l) extending from the distal edge 132 of the tab portion to the second fold line 133 and the base portion 122 has a length (L1) that is less than about 25 percent of (l).

Figure 5:
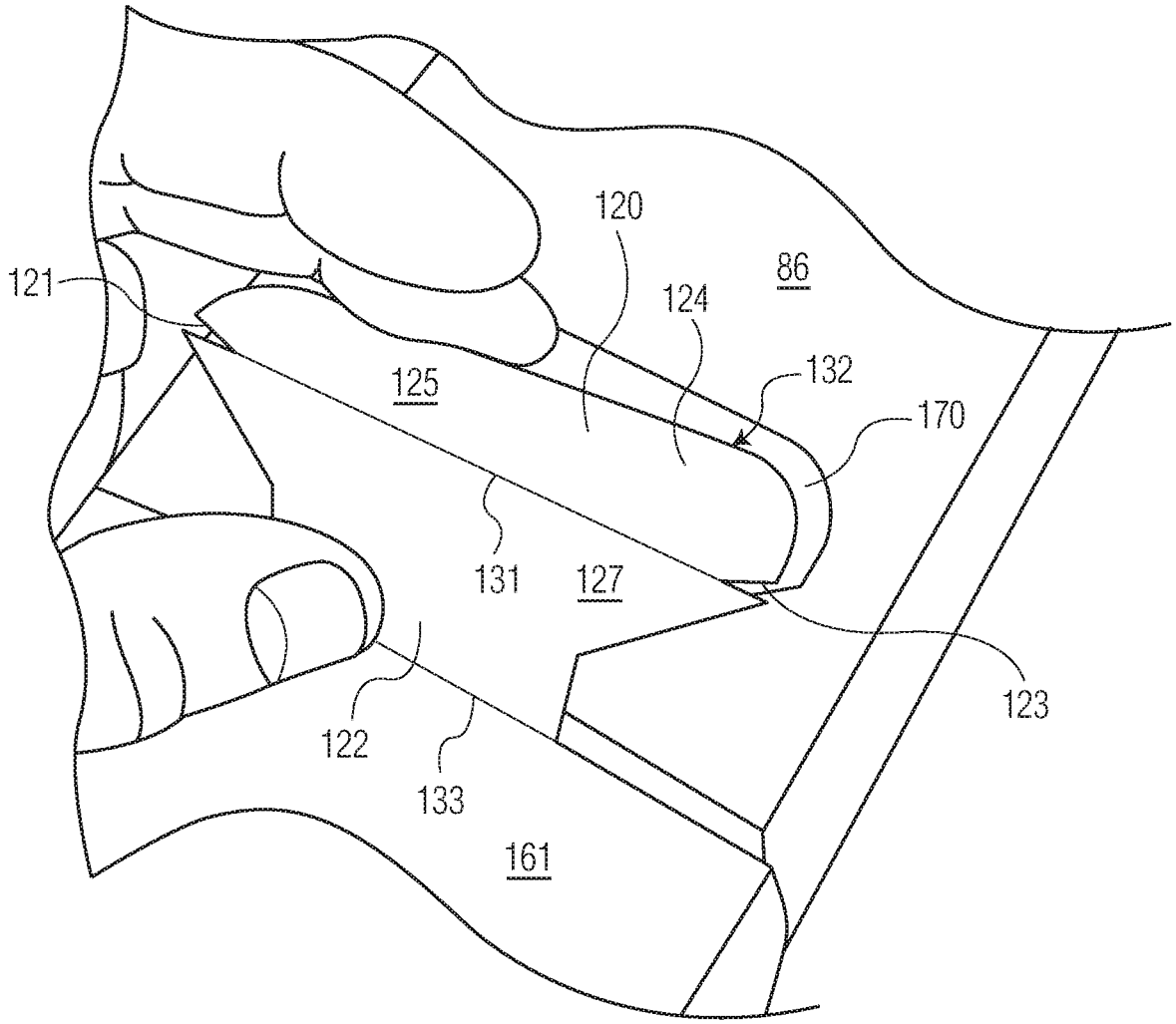
FIG. 5 is a perspective view of the carton of the present invention showing the tuck tab being separated from the top panel of the carton by a user and folded to prepare for securing the tab.

With reference now to FIG. 5, to close the carton and lock the interior tuck tab 120, the tab 120 is first folded along fold first and second fold lines 131, 133 positioning the base portion 122 upward and the first portion 125 of tab portion 124 downward. In this manner the base portion 122 and the first portion 125 of tab portion 124 may be folded into partial overlapping relationship with one another. As the base portion 122 and the first portion 125 of tab portion 124 are folded into partial overlapping relationship with one another the notches 121, 123 are opened. The tab 120 is then bent downwards and inserted into the void 170 created by removal of the tuck tab 120 in the first instance. The notches 121, 123 at either end of the first fold line 131 are engaged with the perimeter portion of the void 170. The angle of the void 170, which generally corresponds to the second portion 127 of the tab portion 124, facilitates considerable overlapping between the notches 121, 123 and the top panel 86 resulting in a two-point locking construction with the lid and prevents inadvertent opening of the closed carton.

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto and the foregoing embodiments:

First embodiment: An enclosed carton having a first panel in folded connection with a second panel, the first panel having an interior tuck tab disposed thereon, the interior tuck tab comprising a perimeter defined by a line of weakness for separating the interior tuck tab from the first panel; a first fold line for hingedly connecting the interior tuck tab to the top panel and a second fold line spaced apart from the first fold line; and a pair of notches disposed on the interior tuck tab substantially parallel to the second fold line.

Second embodiment: The interior tuck tab of the first embodiment wherein the first and second fold lines are substantially parallel to one another.

Third embodiment: The interior tuck tab of any one of the first or second embodiments wherein the interior tuck tab has a width and the width of the interior tuck tab at the first fold line is less than its width at the second fold line.

Fourth embodiment: The interior tuck tab of any one of the first through third embodiments wherein the interior tuck tab has opposed side edges and the side edges are arranged at an angle (0) from about 30 to about 45 degrees.

Fifth embodiment: The interior tuck tab of any one of the first through fourth embodiments wherein the interior tuck tab has a length (l) and the first and second fold lines are spaced apart a distance (l2) wherein the ratio of (l) to (l2) is from about 10:1 to about 2:1.

Sixth embodiment: The interior tuck tab of any one of the first through fifth embodiments wherein the interior tuck tab has a distal end that is substantially linear and parallel to the first and second fold lines.

Seventh embodiment: The interior tuck tab of any one of the first through sixth embodiments further comprising a base portion extending from the first fold line.

Eighth embodiment: The interior tuck tab of any one of the first through seventh embodiments further comprising a base portion that is contiguous with a tab portion, which together define the interior tuck tab.

Ninth embodiment: The interior tuck tab of any one of the first through eighth embodiments further comprising a base portion and wherein the line of weakness defining the base portion and the tab portion is arranged at an angle (θ) from about 30 to about 45 degrees.

Tenth embodiment: The interior tuck tab of any one of the first through ninth embodiments wherein the second fold line terminates at the pair of notches.

What is claimed is:

1. An enclosed carton having a first panel in folded connection with a second panel, the first panel having an interior tuck tab disposed thereon, the interior tuck tab comprising:

a perimeter defined by a line of weakness for separating the interior tuck tab from the first panel;

a first fold line for hingedly connecting the interior tuck tab to the first panel and a second fold line spaced apart from the first fold line; and a pair of notches disposed on the interior tuck tab at either end of the second fold line, aligned with and substantially parallel to the second fold line; and wherein the interior tuck tab has a width and the width of the interior tuck tab at the first fold line is less than its width at the second fold line.

2. The interior tuck tab of claim 1 wherein the first and second fold lines are substantially parallel to one another.

3. The interior tuck tab of claim 1 wherein the interior tuck tab has opposed side edges and the side edges are arranged at an angle (θ) from about 20 to about 50 degrees.

4. The interior tuck tab of claim 1 wherein the interior tuck tab has a length (l) and the first and second fold lines are spaced apart a distance (l2) wherein the ratio of (l) to (l2) is from about 10:1 to about 2:1.

5. The interior tuck tab of claim 1 wherein the interior tuck tab has a distal end that is substantially linear and parallel to the first and second fold lines.

6. The interior tuck tab of claim 1 further comprising a base portion extending from the first fold line.

7. The interior tuck tab of claim 6 wherein the base portion comprises a pair of spaced apart, parallel, side edges having a length from about 10 to about 30 mm.

8. The interior tuck tab of claim 6 wherein the base portion is contiguous with a tab portion, which together define the interior tuck tab.

9. The interior tuck tab of claim 8 wherein the line of weakness defining the base portion and the tab portion is arranged at an angle (θ) from about 30 to about 45 degrees.

10. The interior tuck tab of claim 1 wherein the second fold line terminates at the pair of notches.

11. An enclosed carton for storing and dispensing a plurality of consumer goods comprising:

a top panel, side panels, a bottom panel, and closed ends;

a dispenser hingedly attached to a panel or a closed end, the dispenser moveable through an open and a closed position and creating an opening through which the consumer goods may be removed from the carton; and an interior tuck tab formed entirely within a panel or a closed end and hingedly attached thereto by a first fold line, wherein the interior tuck tab comprises a perimeter defined by a line of weakness for separating the interior tuck tab from the first panel or closed end, a base portion, a tab portion having first and second ends, the first end separated from the second end by a second fold line and the first end extending continuously from the base portion; and a pair of notches disposed on the tab portion at either end of the second fold line, aligned with and substantially parallel to the second fold line wherein the interior tuck tab has a width and the width of the interior tuck tab at the first fold line is less than its width at the second fold line.

12. The enclosed carton of claim 11 wherein the dispenser is hingedly connected to a closed end.

13. The enclosed carton of claim 11 wherein the dispenser is a unitary structure comprising a portion of the top panel, portions of the side panels, and a portion of the opening end, said portions being defined by a line of weakness extending across the top panel and side panels.

14. The enclosed carton of claim 13 wherein the interior tuck tab is disposed entirely within the top panel and is hingedly connected thereto by the first fold line.

15. The enclosed carton of claim 11 wherein the interior tuck tab has a length (l) and wherein the ratio of the length (l) to the distance between the first and second fold lines is from about 10:1 to about 2:1.

16. The enclosed carton of claim 11 wherein the second end of the tab portion has a first edge that is substantially linear and parallel to the first and second fold lines.

17. The enclosed carton of claim 11 wherein the interior tuck tab has opposed side edges and the side edges are arranged at an angle (θ) from about 20 to about 50 degrees.

18. The enclosed carton of claim 11 wherein the second end of the interior tuck tab has a substantially straight first edge that is substantially parallel to the first and second fold lines.

19. The enclosed carton of claim 11 wherein the second fold line terminates at the pair of notches.

20. The enclosed carton of claim 11 wherein the dispenser may be removably secured to the top panel by interlocking the interior tuck tab and a portion of the top panel.

* * * * *